US005743959A

United States Patent [19]

Ash et al.

[11] Patent Number: 5,743,959

[45] Date of Patent: Apr. 28, 1998

[54] REUSABLE APPLICATOR TIP

[75] Inventors: Charles E. Ash, Perrysburg, Ohio; Kevin R. Fisher, Warren, Mich.; Wallace F. Krueger; Michael L. Simon, both of Toledo, Ohio; John G. Rock, Harrison Twp., Mich.

[73] Assignee: Libbey-Owens Ford Co., Toledo, Ohio

[21] Appl. No.: 757,729

[22] Filed: Nov. 26, 1996

Related U.S. Application Data

[60] Provisional application No. 60/007,797 Nov. 30, 1995.

[51] Int. Cl.[6] ..... B05C 11/02

[52] U.S. Cl. ..... 118/264; 118/265; 118/266; 156/578; 401/205; 401/207

[58] Field of Search ..... 118/264, 265, 118/266; 401/193, 198, 205, 207; 156/523, 543, 546, 574, 575, 578

[56] References Cited

U.S. PATENT DOCUMENTS

| | | | |
|---|---|---|---|
| 2,041,022 | 5/1936 | Rassmussen | 401/193 |
| 2,180,506 | 11/1939 | Burbig | 118/264 |
| 2,721,347 | 10/1955 | Benkowski | 401/193 |
| 3,014,833 | 12/1961 | Lee | 118/264 |
| 3,231,924 | 2/1966 | Lofgren | 401/198 |
| 3,377,124 | 4/1968 | Matsumoto | 401/198 |
| 3,614,940 | 10/1971 | Abrams et al. | 118/266 |
| 4,386,576 | 6/1983 | Johnson | 118/266 |
| 4,605,569 | 8/1986 | Shimada et al. | 118/266 |
| 4,747,720 | 5/1988 | Bellehumeur et al. | 401/205 |
| 4,764,044 | 8/1988 | Konose | 401/205 |
| 4,770,557 | 9/1988 | Pitts | 118/264 |
| 5,131,349 | 7/1992 | Keller et al. | 118/73 |
| 5,336,349 | 8/1994 | Cornils et al. | 156/546 |

*Primary Examiner*—Donald E. Czaja
*Assistant Examiner*—Michael P. Colaianni
*Attorney, Agent, or Firm*—Marshall & Melhorn

[57] ABSTRACT

A reusable applicator tip for applying a uniform band of liquid material, such as an adhesive compound, along a selected portion of the peripheral margin of sheet material. The apparatus includes a pad block designed for receiving and transmitting liquid material onto a transfer pad for application onto the sheet material. The liquid flows through internal channels in the pad block and onto an exposed portion of the transfer pad for application onto the sheet material. The transfer pad is removed and replaced at the end of its useful life permitting continued use of the pad block. The apparatus also includes a removable edge guide which permits the selective replacement of the edge guide for varying sheets of material. Excessively worn edge guides may also be replaced without disposing of the entire pad block.

16 Claims, 2 Drawing Sheets

REUSABLE APPLICATOR TIP

BACKGROUND OF THE INVENTION

1. Field of the Invention

This application is claiming benefit, under 35 USC § 119(e), of the provisional application filed Nov. 30, 1995, under 35 USC § 111(b), which was granted a Ser. No. 60/007,797. The provisional application, Ser. No. 60/007,797, is hereby incorporated by reference.

This invention relates to a reusable applicator tip for applying a liquid material onto a surface, and more particularly to a reusable applicator tip that utilizes flow channels to apply the liquid material onto a replaceable transfer pad for further application onto the marginal edge surface of a glazing unit.

2. Summary of Related Art

The invention is particularly adapted for the production of glazing units or window assemblies for automotive vehicles, although it will find utility generally in many other fields. The production of glazing units for automobiles requires the application of liquid material, such as an adhesive compound, around the marginal edges of the unit. Current applicators used in applying adhesives utilize a transfer pad which permits the flow of the adhesive through the pad and onto the surface of the glazing unit. The transfer pad is generally a felt sleeve having absorbent or wicking capabilities. The applicator tips known in the prior art are generally disposable and thrown away upon expiration of the pad.

The reusable applicator tip in the present invention utilizes flow channels in the tip to convey the adhesive around the pad and introduce the adhesive to the transfer pad at the point of application. The applicator tip in the present invention also permits the replacement of the transfer pad at the end of its useful life and thereby avoids the disposal of the entire tip.

U.S. Pat. No. 5,131,349 discloses a system for applying a uniform band of liquid primer or adhesive onto the marginal edge surface of a glazing unit. The system utilizes disposable applicator tips to apply the adhesive directly onto the edge surface. The applicator tip utilizes a transfer pad that is permanently affixed in the applicator base. The adhesive is introduced to the transfer pad at the base of the pad where it flows through the pad and is then applied onto the marginal edge of the glazing.

The applicator tip, as described in U.S. Pat. No. 5,131,349, is utilized until the pad either wears out or dries up, after which the entire applicator tip is disposed. Additionally, the adhesive often plugs the opening at the base of the transfer pad which leads to premature failure of the applicator tip. The replacement of the entire tip is a costly practice, particularly if the tip wears or plugs up after completing only a few glazings.

The drying or wearing of the applicator tip also creates quality issues by applying a non-uniform band of adhesive onto the glazing. The tip also includes an edge guide permanently attached to the apparatus. The edge guide contacts the edge of the sheet material to maintain the appropriate position of the transfer pad on the sheet as the adhesive is applied. The edge guides vary in dimension depending upon the position and form of band desired on the glazing and upon the dimensions of the glazing. The edge guide also wears over time and may necessitate a change of the applicator tip.

It would be advantageous to have an applicator tip that utilizes a flow channel to permit fluid flow around a transfer pad and introduce the liquid material to the transfer pad at the point of application. The tips known in the art presently flow the adhesive directly through the transfer pad which creates pluggage problems and the premature wear and failure of the pad. The wear and drying out of the felt overtime during the application process adversely affects the lay down of the liquid material onto the surface of the glazing.

It would also be an advantage to have an applicator tip that permits the replacement of the transfer pad. The present tips have transfer pads that are permanently attached in the applicator base and do not permit the replacement of the pad. Upon failure or excessive wear of the pad, the entire applicator tip is disposed.

It would also be advantageous to provide an apparatus that permits the selective changing of edge guides. The edge guides assist in traversing the edge of the glazing. The known applicator tips have permanent edge guides that require the stocking of numerous tips covering the various edge guide arrangements for different glazing configurations.

SUMMARY OF THE INVENTION

In accordance with the present invention, there is provided a reusable applicator tip for applying a uniform band of liquid material, such as an adhesive compound, along a selected portion of the peripheral margin of sheet material. The apparatus includes a pad block designed for receiving and transmitting liquid material onto a transfer pad for application onto the sheet material. The transfer pad is removed and replaced at the end of its useful life permitting continued use of the pad block. The apparatus also includes a removable edge guide which permits the selective replacement of the edge guide for varying sheets of material. Excessively worn edge guides may also be replaced without disposing of the entire pad block.

The reusable applicator tip of the present invention includes a pad block having opposing ends. One end of the pad block includes a cylindrical coupling extension which serves to connect and provide fluid communication between the pad block and a liquid dispensing means. A transfer pad base is positioned at the other end of the applicator tip. An internal chamber is created by an annular opening extending from the cylinder coupling extension to the transfer pad base. At least one flow channel extends from the chamber into the transfer pad base. The channel is in fluid communication with the liquid dispensing means through the chamber.

A recess is formed in the transfer pad base to hold a transfer pad. The transfer pad is removably fitted into the recess and extends outward from the transfer pad base. An opening in the transfer pad base to the channel permits the flow of liquid from the liquid dispensing means through the channel and onto the transfer pad. The liquid material is then deposited as a band onto the peripheral marginal surface upon the movement of the applicator tip and wiping contact of the transfer pad with the sheet of material.

It is an object of the present invention to provide a reusable applicator tip for applying a uniform band of liquid material, such as an adhesive compound, along a selected portion of the peripheral margin of sheet material. The reusable tip utilizes a flow channel to permit fluid flow of a liquid material onto a transfer pad at the point of application. The introduction of the liquid material to the transfer pad at the point of application eliminates the use of the transfer pad as a wick or conveying means for the liquid material. This practice eliminates the pluggage problems and reduces the premature wear and failure of the pad.

It is also an object of the present invention to provide an applicator tip that permits the replacement of the transfer pad. In accordance with the present invention, the transfer pad is removably positioned in the transfer pad base. Therefore, a worn pad may be removed and replaced with a new transfer pad without throwing away the entire pad block.

It is still another object of the present invention to provide an applicator tip that permits the selective changing of edge guides on the transfer pad base. The present invention utilizes a bore in the transfer pad base to hold various size edge guides. The edge guides assist in traversing the peripheral margin of the sheet material and maintain the liquid band at a desired location on the sheet relative to the edge of the glazing.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE PREFERRED EMBODIMENT

Figure 1:
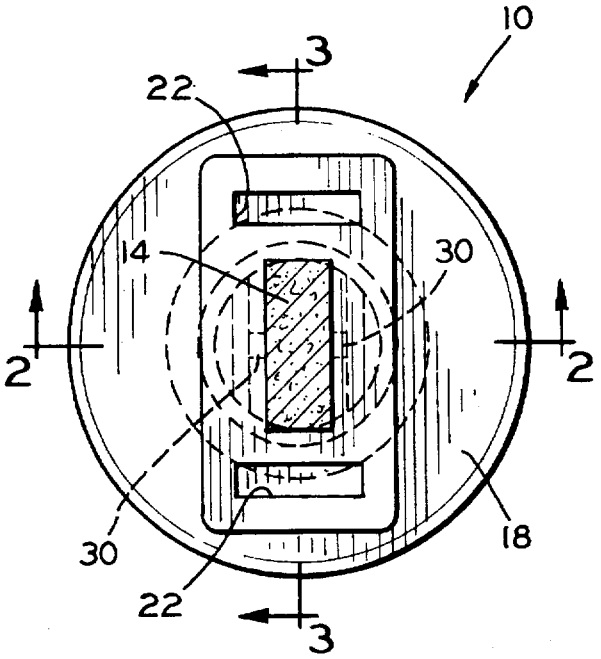
FIG. 1 includes a top view of the applicator tip of the present invention.
Figure 4:
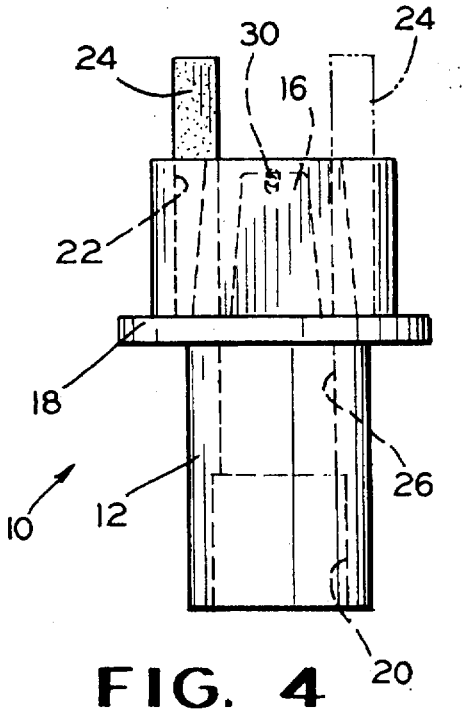
FIG. 4 is a side view of the applicator tip with an edge guide in place and second edge guide indicated in phantom.
Figure 2:
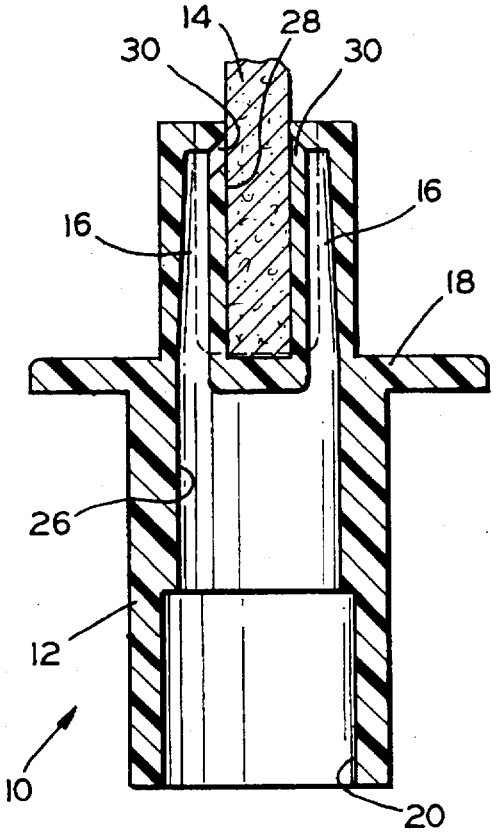
FIG. 2 is a side view of the applicator tip along datum 2—2 of FIG. 1.
Figure 3:
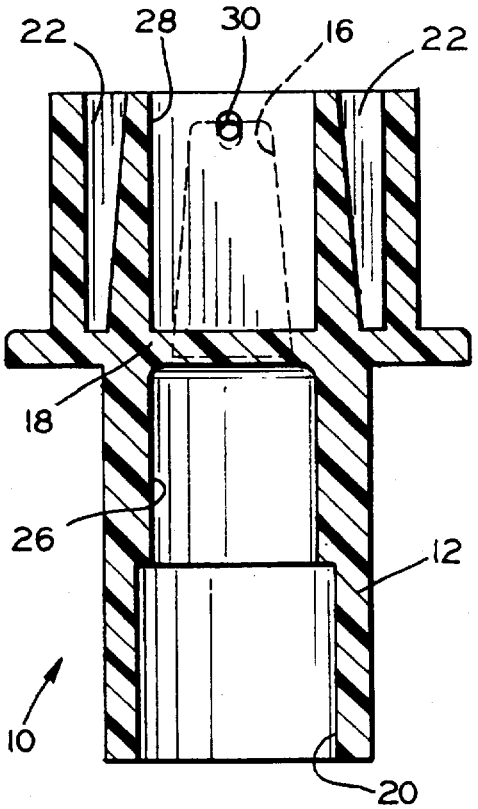
FIG. 3 is a side view of the applicator tip along datum 3—3 of FIG. 1.

There is shown generally in FIGS. 1–4 a reusable applicator tip 10 in accordance with the present invention for applying a band of liquid material onto a surface. The applicator tip 10 comprises a pad block 12 for holding a transfer pad 14. The transfer pad 14 serves as the contact element for applying a liquid material onto a marginal edge surface of a glazing unit (not shown). The liquid material is conveyed to the transfer pad 14 at the point of application through flow channels 16 located internally in the pad block 12.

The pad block 12 utilized in practicing the present invention includes a transfer pad base 18 and a cylindrical coupling extension 20 located at opposing ends of the pad block 12. The cylindrical coupling extension 20 provides fluid communication with a liquid dispensing means (not shown). The transfer pad base 18 holds the transfer pad 14 and provides a flow channel for the liquid which enables the liquid to be applied onto the transfer pad. The transfer pad base 18 also includes bores 22 for selectively holding edge guides 24 which direct the transfer pad 14 along the peripheral edge of a glazing.

The cylindrical coupling extension 20 connects to the dispensing means for the liquid material. The extension 20 generally includes an annular bore integrally formed within the pad block. The extension 20 provides a mating connection to the dispensing means. The mating connection may include various forms of conventional connecting mechanisms, such as a threaded connection or a coupling. The liquid dispensing means may also take various forms. For example, the liquid dispensing means may comprise an automated or manually operated applicator gun or a manually operated or a hand held squeeze type dispenser. All of the dispensing means include the appropriate mating connection with the cylindrical coupling extension 20 and deliver a pressurized liquid material to the pad block 12.

The pad block 12 utilizes an internal chamber 26 and a flow channel 16 to deliver the liquid material to the transfer pad 14 at the point of application. Preferably, the internal chamber 26 is integrally formed internally in the pad block 12 between the cylindrical coupling extension 20 and the transfer pad base 18. The internal chamber 26 may be formed as an annular opening within the pad block 12 that serves as a reservoir for the liquid material and a connecting point for the flow channel 16 located in the transfer pad base 18.

In accordance with the present invention, the transfer pad base 18 located on the pad block 12 functions as a holding unit for both the transfer pad 14 and the edge guides 24 as well as incorporating the flow channels 16. The transfer pad base 18 has a recess 28 which removably holds a transfer pad 14. The recess 28 is integrally formed in the transfer pad base 18 and is deep enough to hold the transfer pad 14 in place while the exposed end of the pad is in movement against the surface of the glazing. At least one flow channel 16 runs from the internal chamber 26 through the transfer pad base 18 to the outer edge of the base. The flow channel 16 is generally located close to the recess 28 so that an opening 30, directed from the top outer edge of the recess 28 to the channel 16, permits the flow of the liquid material onto the transfer pad 14. Preferably, two flow channels 16 are located in the transfer pad base 18 to allow the use of the applicator tip 10 in two different directions. The channels 16 are located on opposing sides of the recess 28.

Figure 5:
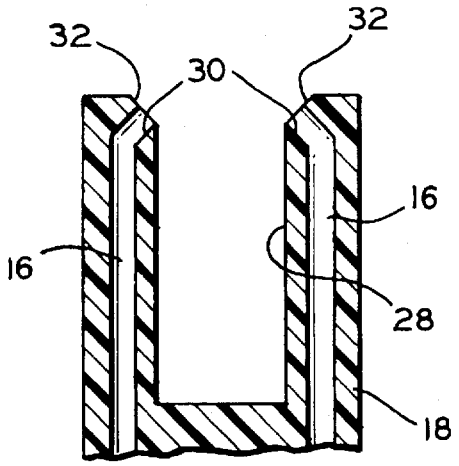
FIG. 5 is a broken side sectional view of the transfer pad base highlighting the beveled portion of the recess.
Figure 6:
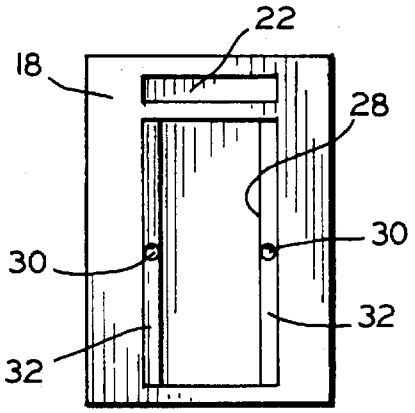
FIG. 6 is a top view of the transfer pad base and the beveled portion of the recess.

In a preferred embodiment, the upper edges of the recess 28 are beveled as indicated in FIGS. 5–6. The opening 30 to the channels 16 is positioned on the beveled portion 32 of the recess. This permits the unobstructed flow of the liquid material directly onto the surface of the transfer pad (not shown). Additionally, the opening 30 on the beveled portion 32 permits direct access to the opening 30 in case the opening should become plugged. The acute angle of the beveled portion 32 and the direct access improves the ability to remove plugged material from the opening 30 and thereby prevent the necessity to dispose of the entire pad block.

The transfer pad base 18, as illustrated in FIGS. 1–4, also includes edge guide bores 22 which permit the positioning and selective removal of edge guides 24 in the pad block 12. Edge guides 24 are utilized in the present invention to maintain the transfer pad 14 at a given distance from the edge of the glazing. There are generally two bores 22 positioned in the transfer pad base 18 at opposing sides of the base. Typically, only one edge guide 24 is utilized at a given time. The multiple bores 22 provide various positions for different directions of movement with the tip 10 for different glazing configurations.

Figure 7:
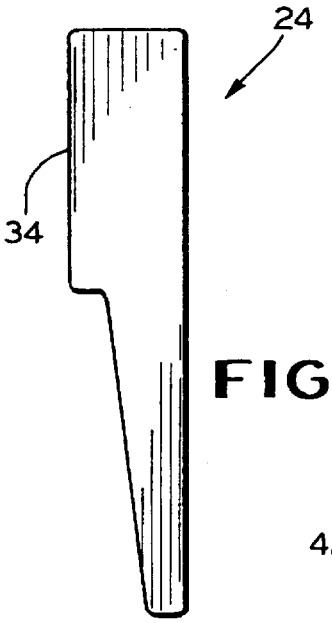
FIG. 7 is a side view of an edge guide in accordance with the present invention.
Figure 8:
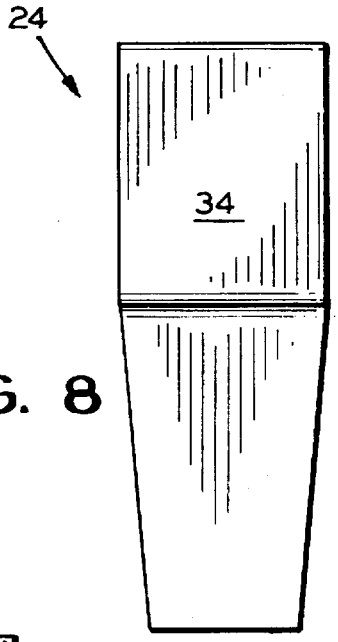
FIG. 8 is a front view of the edge guide.

The edge guides 24, illustrated in FIGS. 7–8, are removably positioned in the edge guide bores. The edge guides 24 generally include a flat surface 34 extending from the transfer pad base that contacts the edge of the article upon which the liquid material is being applied. In accordance with the present invention, the edge guides 24 are provided in various sizes and configurations to permit the exchange of edge guides 24 with various glazing configurations.

Figure 9:
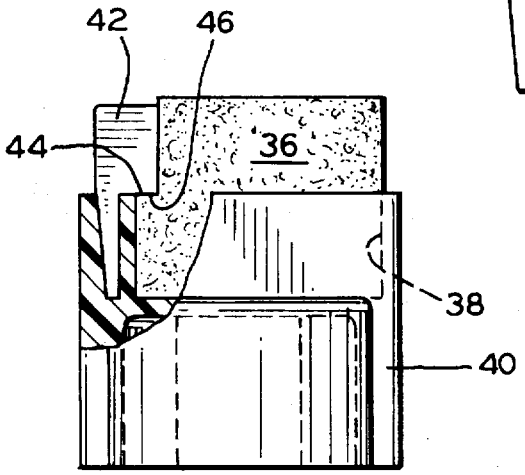
FIG. 9 is a side view of the pad block with a portion broken away to illustrate a notched transfer pad and a laterally extending edge guide.

A preferred embodiment of the present invention is illustrated in FIG. 9. A notched transfer pad 36 is placed in the recess 38 of the transfer pad base 40. The notch 46 is positioned in the transfer pad base 40 near the side in which the edge guide 42 will be placed. The edge guide 42, having a laterally extending surface 44, is placed in the transfer pad base 40 alongside the transfer pad 36. The laterally extending surface 44 fits over the lower edge of the notch 46 to secure the transfer pad 36 in place within the recess of the transfer pad base 40. Thus, the edge guide 42 serves as a locking mechanism to retain the transfer pad 36 in position during operation. Upon excessive wear, the transfer pad 36 may be replaced by first removing the edge guide 42 and then removing the transfer pad 36 from the transfer pad base 40.

The pad block and the edge guides of the present invention are generally molded plastic articles. High density polyethylene or high density polypropylene is generally used for molding the articles. However, other materials which are capable of forming the articles are also suitable for practicing the present invention.

In accordance with the present invention, the transfer pad is generally made of absorbent, fibrous material. Both synthetic or natural fibers are suitable for use in the transfer pad. A felt sleeve is typically used as the transfer pad to apply the liquid material onto the surface of the glazing. The liquids typically used in practicing the present invention may include adhesives or primers.

As illustrated in FIGS. 1–4, the applicator tip 10 of the present invention is generally placed onto an applicator gun or a hand held squeeze dispenser. Additionally, the applicator tip 10 may be utilized on an automatic system as disclosed in U.S. Pat. No. 5,131,349, hereby incorporated by reference. In the present invention, a threaded screw cap is generally used to secure the applicator tip 10 onto the applicator device. The screw cap is heat welded to the pad block 12 at the transfer pad base 18. The screw cap then permits the attachment of the applicator tip 10 to the device and the mating of the liquid dispensing means to this cylindrical coupling extension 20. Alternatively, the screw cap and pad block may be molded as a single unit.

In operation, the applicator tip 10 of the present invention is connected to the liquid dispensing means. The liquid material is selectively pressurized either manually or automatically through the liquid dispensing means. The pressurized liquid material is admitted to the internal chamber 26 and into the flow channel 16 of the pad block. The liquid then flows through the flow channel 16 and out of the opening 30 onto the transfer pad 14. The applicator tip 10 is in moving contact with the peripheral edge of the glazing at the desired point of application. The edge guide 24 is in contact with the outer edge of the glazing to ensure the desired path of the transfer pad 14 along the peripheral edge of the glazing. After application of the band of liquid material onto the glazing, the applicator tip 10 is withdrawn from contact with the glazing and the pressure of the liquid material at the liquid dispensing means selectively turned off.

It is to be understood that the forms of the invention herewith shown and described are to be taken as illustrative embodiments only of the same, and that various changes in the shape, size and arrangement of parts, as well as various procedural changes, may be resorted to without departing from the spirit of the invention.

We claim:

1. A reusable applicator tip for applying a liquid material to at least one peripheral marginal surface of a sheet of material, comprising:

(A) a pad block having opposing ends, one end having a cylindrical coupling extension, the opposing end forming a transfer pad base, said coupling extension in fluid communication with a liquid dispensing means;

(B) an internal chamber created by an annular opening extending from said cylindrical coupling extension to said transfer pad base;

(C) a recess extending into said transfer pad base;

(D) a transfer pad removably fitted into the recess of said transfer pad base and extending outwardly beyond said transfer pad base;

(E) at least one channel extending from said internal chamber into said transfer pad base, said channel in fluid communication with the fluid dispensing means through said internal chamber; and (F) an opening in said transfer pad base to said channel, said opening located at an upper extremity of said recess to permit flow of the liquid material from said channel onto an outer surface of said transfer pad wherein said liquid material is deposited as a band onto a peripheral marginal surface of a sheet of material upon movement of said applicator tip and wiping contact of said transfer pad with said sheet of material.

2. A reusable applicator tip as recited in claim 1, including at least one bore extending into said transfer pad base and an edge guide removably positioned in said bore, said edge guide for slidingly engaging an edge of said sheet of material as said applicator tip and sheet are moved relative to each other.

3. A reusable applicator tip as recited in claim 2, wherein said pad block and said edge guide are made of molded plastic material.

4. A reusable applicator tip as recited in claim 1, wherein said transfer pad is made of a natural or synthetic absorbent material.

5. A reusable applicator tip as recited in claim 1, wherein said recess has beveled upper edges, said opening located on said beveled upper edges to permit the flow of liquid material onto an exposed surface of said transfer pad.

6. A reusable applicator tip as recited in claim 2, wherein said transfer pad has a notch, said notch positioned near the point of insertion of the edge guide, said edge guide having a laterally extending surface so that as said edge guide is placed into said bore the laterally extending surface extends into and over the notch of said transfer pad thereby locking said transfer pad into said recess while said edge guide is positioned in the bore of said transfer pad base.

7. A reusable applicator tip as recited in claim 2, wherein said transfer pad base has a plurality of bores to permit the selective placement of the edge guides in said transfer pad base.

8. A reusable applicator tip for applying a liquid material to at least one peripheral marginal surface of a sheet of material, comprising:

(A) a pad block having opposing ends, one end having a cylindrical coupling extension, the opposing end forming a transfer pad base, said coupling extension in fluid communication with a liquid dispensing means;

(B) an internal chamber created by an annular opening extending from said cylindrical coupling extension to said transfer pad base;

(C) a recess extending into said transfer pad base;

(D) a transfer pad removably fitted into the recess of said transfer pad base and extending outwardly beyond said transfer pad base;

(E) at least one channel extending from said internal chamber into said transfer pad base, said channel in fluid communication with the fluid dispensing means through said internal chamber;

(F) an opening in said transfer pad base to said channel, said opening located at an upper extremity of said recess to permit flow of the liquid material from said channel onto an outer surface of said transfer pad;

(G) at least one bore extending into said transfer pad base; and (H) an edge guide removably positioned in said bore, said edge guide for slidingly engaging an edge of a sheet of material as said applicator tip and said sheet are moved relative to each other, wherein upon movement said liquid material is deposited as a band onto a peripheral marginal surface of said sheet of material upon wiping contact of said transfer pad with said sheet of material.

9. A reusable applicator tip as recited in claim 8, wherein said recess has beveled upper edges, said opening located on said beveled upper edges to permit the flow of liquid material onto an exposed surface of said transfer pad.

10. A reusable applicator tip as recited in claim 8, wherein said transfer pad has a notch, said notch positioned near the point of insertion of the edge guide, said edge guide having a laterally extending surface so that as said edge guide is placed into said bore the laterally extending surface extends into and over the notch of said transfer pad thereby locking said transfer pad into said recess while said edge guide is positioned in the bore of said transfer pad base.

11. A reusable applicator tip as recited in claim 8, wherein said transfer pad base has a plurality of bores to permit the selective placement of the edge guides in said transfer pad base.

12. A reusable applicator tip as recited in claim 8, wherein said transfer pad is made of a natural or synthetic absorbent material.

13. A reusable applicator tip as recited in claim 8, wherein said pad block and said edge guide are made of molded plastic material.

14. A reusable applicator tip for applying a liquid material to at least one peripheral marginal surface of a sheet of material, comprising:

(A) a pad block having opposing ends, one end having a cylindrical coupling extension, the opposing end forming a transfer pad base, said coupling extension in fluid communication with a liquid dispensing means;

(B) an internal chamber created by an annular opening extending from said cylindrical coupling extension to said transfer pad base;

(C) a recess extending into said transfer pad base;

(D) a transfer pad removably fitted into the recess of said transfer pad base and extending outwardly beyond said transfer pad base, said transfer pad having a notch;

(E) at least one channel extending from said internal chamber into said transfer pad base, said channel in fluid communication with the fluid dispensing means through said internal chamber;

(F) an opening in said transfer pad base to said channel, said opening located at an upper extremity of said recess to permit flow of the liquid material from said channel onto an outer surface of said transfer pad;

(G) at least one bore extending into said transfer pad base; and (H) an edge guide removably positioned in said bore and having a laterally extending surface, said laterally extending surface extends into and over the notch of said transfer pad thereby locking said transfer pad into said recess while said edge guide is positioned in the bore of said transfer pad base, said edge guide for slidingly engaging an edge of a sheet of material as said applicator tip and said sheet are moved relative to each other, wherein upon movement said liquid material is deposited as a band onto a peripheral marginal surface of said sheet of material upon wiping contact of said transfer pad with said sheet of material.

15. A reusable applicator tip as recited in claim 14, wherein said recess has beveled upper edges, said opening located on said beveled upper edges to permit the flow of liquid material onto an exposed surface of said transfer pad.

16. A reusable applicator tip as recited in claim 14, wherein said transfer pad base has a plurality of bores to permit the selective placement of the edge guides in said transfer pad base.

* * * * *